US008661987B2

(12) United States Patent
Urich et al.

(10) Patent No.: US 8,661,987 B2
(45) Date of Patent: Mar. 4, 2014

(54) TRANSPORT SYSTEM HAVING A POSITIVE DRIVE

(75) Inventors: Richard Urich, Moehlin (CH); Juerg Jakob, Ittigen (CH)

(73) Assignee: Joerg Beutler, Holzkirchen (DE)

( * ) Notice: Subject to any disclaimer, the term of this patent is extended or adjusted under 35 U.S.C. 154(b) by 0 days.

(21) Appl. No.: 13/499,641

(22) PCT Filed: Sep. 30, 2010

(86) PCT No.: PCT/EP2010/064615

§ 371 (c)(1),
(2), (4) Date: Aug. 17, 2012

(87) PCT Pub. No.: WO2011/039335

PCT Pub. Date: Apr. 7, 2011

(65) Prior Publication Data

US 2012/0304884 A1 Dec. 6, 2012

(30) Foreign Application Priority Data

Sep. 30, 2009 (DE) ..... 10 2009 044 141

(51) Int. Cl.
*B61C 11/00* (2006.01)

(52) U.S. Cl.
USPC ..... 105/29.1; 104/118

(58) Field of Classification Search
USPC ..... 105/29.1, 26.05; 104/118, 165, 172.1, 104/172.2, 172.3, 172.4, 172.5
See application file for complete search history.

(56) References Cited

U.S. PATENT DOCUMENTS

| | | | | | |
|---|---|---|---|---|---|
| 3,590,745 | A * | 7/1971 | Ouska et al. | ..... | 104/172.3 |
| 3,854,418 | A * | 12/1974 | Bertin | ..... | 105/29.1 |
| 3,901,162 | A * | 8/1975 | Bertin | ..... | 105/29.1 |
| 4,266,484 | A * | 5/1981 | Jochums et al. | ..... | 105/29.1 |
| 4,353,308 | A * | 10/1982 | Brown | ..... | 105/29.1 |
| 7,255,220 | B2 * | 8/2007 | Iwai et al. | ..... | 198/465.3 |
| 2012/0304884 | A1 * | 12/2012 | Urich et al. | ..... | 104/118 |

FOREIGN PATENT DOCUMENTS

| | | | |
|---|---|---|---|
| AT | 413091 | B | 11/2005 |
| CH | 625169 | A5 | 9/1981 |
| DE | 1755927 | A1 | 12/1971 |
| DE | 2552544 | A1 | 6/1977 |

OTHER PUBLICATIONS

International Search Report and Examination Report for PCT Patent Application No. PCT/EP2010/064615 dated Feb. 15, 2011, 11 pgs.

* cited by examiner

*Primary Examiner* — Jason C Smith
(74) *Attorney, Agent, or Firm* — Edwards Wildman Palmer LLP; David I. Greenbaum; David A. Tucker

(57) ABSTRACT

A transport system according to the invention comprises a guide device having a first guide rail in the form of a first pipe (11) and a second guide rail in the form of a second pipe (12). The transport system comprises a toothed driving disk (330), which is engaged with an engagement element (340) extending along the lower pipe (12) and forms a positive drive. The engagement element (340) comprises counter-toothing, disposed along the pipe (12).

29 Claims, 7 Drawing Sheets

TRANSPORT SYSTEM HAVING A POSITIVE DRIVE

CROSS-REFERENCE TO RELATED APPLICATION

This application is a national phase application of PCT/EP2010/064615, filed Sep. 30, 2010, which claims priority to German Patent Application No. 102009044141.7, filed Sep. 30, 2009, each of which is hereby incorporated by reference.

TECHNICAL FIELD

The present invention relates to a transport system, in particular a rail passenger transport system in the private sector, comprising: a vehicle for accommodating at least one passenger; a circuit with a guide device along which the vehicle can be moved; and a drive system for a positive drive to propel the vehicle along the circuit, wherein, at least on sections extending along the circuit, the drive system has a first engagement element and a second engagement element, which is connected to the vehicle and which is propellable.

BACKGROUND

Transport vehicles with positive drives are known, for example, cog railways and in the mining industry. Positive drives have an advantage over friction drives in that the efficiency can be improved because the drive wheel in the case of a positive connection cannot slip on the drive rail. In addition, greater torques and thus greater accelerations can be transferred from the drive to the vehicle.

These drives have already been proposed for use in roller coasters, too. However, there is the problem that the rack limits the possibilities for the realization of certain routes. As roller coasters are intended to thrill users by traversing the most spectacular possible thrill elements, a complicated route with more or less steep rises (e.g. camel back), curves, twists (e.g. screw), and also combinations of these (e.g. cork screw), must be realized in many cases. However, since the racks, as well as the guide elements (rails), are not freely bendable and twistable, there is limited scope for designing the circuit.

Since the rack generally in addition to the rails is attached, for example, between a dual line of rails, it is difficult to integrate such a roller coaster into an existing landscape or environment. In the case of a dual rail track, the passengers always see the rails and the toothing and so can easily anticipate the course. This can partially reduce the thrill of the ride.

Furthermore, positive drives suffer from the fundamental problem of high wear and high noise levels. This gives rise to higher energy requirements and can detract from the quality of the ride during transport of persons.

SUMMARY

Proceeding therefrom, the object of the present invention is to provide a transport system with a positive drive system, which is improved with regard to wear, running smoothness and efficiency over conventional positive-drive transport systems.

This object is achieved by a transport system in accordance with claim 1. Advantageous characteristics and preferred embodiments will become apparent from the dependent claims.

An inventive transport system comprises: a vehicle for accommodating at least one passenger; a circuit with a guide device along which the vehicle can be moved; and a drive system for a positive drive for propelling the vehicle along the circuit, wherein, at least on sections extending along the circuit, the drive system has a first engagement element and a second engagement element, which is connected to the vehicle and which is propellable.

At least the first engagement element or the second engagement element has cylinders which are arranged at spaced intervals from each other.

The claimed transport system can be used in a plurality of applications, e.g., rides, in alpine areas, for the general transport of persons, indoors, etc. It is particularly suitable for use in applications in which a vehicle must overcome height differences.

By first engagement element is understood the elongated element arranged on the route that has means for meshing with a complementary second engagement element arranged on the vehicle. The second engagement element is usually an element which has a circular circumference and toothing along the circumference, or pinion. The first engagement element can for example be formed as a rack or chain, in particular a flyer chain. The second engagement element is typically formed on the circumference of the drive wheel, for example a driving disk.

At least the first engagement element or the second engagement element comprises cylinders arranged adjacent to each other, i.e. a kind of cage gear. The scope of the invention extends inter alia to both cage gears and crown gears. The crown wheel is a type of cage gear. The running surface of crown wheels is formed on the wheel surface, unlike the case for spur gears where the running surface is formed on the end face. A cage cog wheel can also be used within the scope of the invention.

The term "cage gear" is used interchangeably in the following for all embodiments having toothing elements with cylinders arranged adjacent to each other. The term cylinder moreover is not understood as being restricted to a circular cross-section of the means of engagement. Also, other cross-sections of the means of engagement which correspond to the cylinders and which are useful within the context of the invention are to be construed as encompassed by the term or at least considered to be equivalents.

The cylinders arranged adjacent to each other form the toothing of one of the two engagement elements. The counter-toothing may be a pinion or a rack.

Preferably, the counter-toothing is an element which is arranged along the circuit and which has toothing facing the cylinders.

When driving the vehicle, it is therefore a positive drive, in which at least one of the engagement elements has cylinders. The use of a positive drive can achieve the desired flexibility and pitch tolerance. Both during propulsion and braking ("controlled braking"), the positive engagement ensures that no losses due to slippage of the drive arise.

In one embodiment of the invention, the toothing can be provided in the form of chain pins or in the form of a chain are provided (for example as a sprocket or chain arranged along the circuit). Any chain, in particular steel link chains, which can serve as drive chains for transmitting torques, can be used within the scope of the invention. Examples include bush, roller, flyer, arc or pin chains. The term chain within the scope of the invention can also be taken to mean a toothed belt which, in the inventive transport system, can serve as rack together with a toothed belt pulley as pinion. Toothed belts have teeth of plastic that correspond to the chain links with a tooth profile shape.

The vehicle in the inventive transport system is arranged, for example, above the guide device (from the perspective of a passenger properly accommodated in the vehicle). The centre of gravity of the laden or unladen vehicle is always above, albeit as close as possible to, the first and/or second guide element. Thus, a seat arrangement can be provided, wherein at least one of the rails (first and/or second guide element) is arranged between the legs of a passenger or at least one of the rails (first and/or second guide element) is arranged between two adjacent seats.

The guide device can have one or at least two guide elements. The guide elements can be arranged side by side to form a dual rail circuit. Preferably, in the context of the invention, however, a single-rail circuit is provided for single-rail vehicles ("monorail"). In a monorail, one, preferably two or more guide elements are arranged below one another underneath the vehicle. In particular, instead of one guide plate employed in conventional monorails, a second pipe can be used which is either attached directly to the other carrier pipe or connected with the aid of cross members at a distance, yet rigidly thereto so as to prevent lateral tilting of the vehicle (relative to a plane formed by the guide elements). In particular, the pipes can be vertically offset from one another.

The first engagement element is preferably arranged at least at the guide element or one of the guide elements.

The drive system can have at least one spring damping system, which is arranged between the first and the second guide element or between the drive motor and the drive wheel.

The cylinders, e.g. cage pins of a cage gear, in particular can be arranged at the second engagement element. The particular advantage of this embodiment is that the toothing, which is more complex to make, is provided at the drive wheel. The number of cylinders in the peripheral direction is limited in this regard. Replacement of the drive wheel is possible with reasonable effort. On the circuit, however, a simple counter-toothing is provided, e.g. in the form of a rack which can be produced in a rugged design once and rarely needs to be maintained or replaced.

Preferably, the cylinders each have at least one rotatable element for rolling off the cylinders at the counter-toothing. This configuration does not generate any sliding friction, but rather only rolling friction during rolling off of the cylinders in the concave engaging recesses of the counter-toothing. This reduces wear, noise and energy consumption.

In particular, the rotatable elements have at least one rolling bearing. By rolling bearings (as opposed to sliding bearings) is understood all bearings in which those components which are capable of movement towards each other do not make sliding contact but rather make rolling contact with each other, e.g. ball or needle bearings. The two components capable of movement towards each other may be an inner race and an outer race, which are separated by rolling elements. The friction and thus power loss and wear are low.

Mainly rolling friction occurs between the inner race, outer race and the rolling elements. Therefore, with this type of toothing, a system is provided in which the cylinders roll off the tooth flank during the entire engagement.

The cylinders each have especially at least one pin or a sleeve and a roller encompassing the pin or sleeve, wherein the roller is mounted rotatably at the pin or at the sleeve. The roller rolls off at the counter-toothing during engagement. The provision of a rolling bearing avoids sliding friction.

The cylinders can preferably have a spring damping element which is arranged between those cylinder components which are capable of moving towards each other. The damping element can be formed as a buffer of elastomer.

The cylinders can, in a further embodiment of the invention, have at least one axle and a roller that can rotate about the axle, with the axle arranged rotatably at the first engagement element or at the second engagement element by means of a bearing.

The cylinders can especially in this arrangement have a spring damping element which is arranged between the axle and the roller. The spring damping element can be formed of an elastic material (elastomer, spring steel). The spring damping element can for example also perform a damping function, e.g. be configured as a rubber insert.

Through the agency of the spring damping element, the cylinders are mounted such that they are damped and sprung. This not only serves to dampen impacts, etc., but also effects the most accurate rolling off possible of the wheels on the counter-toothing. The suspension also provides for a flexible adjustment of the orientation of the cylinders to the mating surface, so that line contact is always realized. This in turn improves the running properties of the toothing, and is thus tolerant of pitch and tooth alignment errors as well as axle base and axle inclination errors. Preferably, the components capable of movement towards each other are directly decoupled by the interposition of the damping between said components, i.e. before the bearing (as seen from the line of engagement).

In a particularly preferred embodiment of the invention, the cylinders, in particular rollers, are formed of a material having lower wear resistance than the counter-toothing. As a result, these elements undergo the bulk of the wear during operation. The configuration of the toothing at the drive wheel renders the toothing the "consumable part", while the counter-toothing arranged along the circuit can be used virtually without wear. The material of the contact surfaces of the wear parts is softer than that of the mating-contact surface. In this way, it is possible to control which of the toothings are to be subject to which kind of wear.

The cylinders, in particular rollers, can, for example, be formed of plastic. In any case, the contact surfaces of the rollers with the counter-toothing can be made of plastic in order to prevent rapid wear of the counter-toothing.

The counter-toothing for engaging with the cylinders can preferably be formed as non-involute toothing. Overall, for mutual engagement with the drive wheel, external toothing is required. This can be provided by a rack, but also by a chain.

Preferably, the counter-toothing is formed as cycloid toothing or approximately as cycloid toothing. The contour of the toothing is adapted to the rolling off of the cylinders. The optimal contour can be calculated mathematically and approximates (as opposed to conventional involute toothing) cycloid toothing.

The counter-toothing for engaging with the cylinders can be a rack extending at least along sections of the circuit, whose teeth engage between the chain links/rolls of a chain of the second engagement element. This is a simple and inexpensive solution.

The counter-toothing for engaging with the cylinders can, in another embodiment, comprise a chain extending at least along sections of the circuit, in particular a flyer chain formed as a silent chain. In the direction of travel, for example, a chain that is part of the first engagement element has relatively little play. This applies analogously to a chain which is part of the second engagement element and which is arranged at the circumference of a wheel, a drive wheel, disc, etc., i.e. it has little play in the circumferential direction.

At least one of the engagement elements can comprise a chain which extends at least along sections of the engagement element and which has external toothing for engagement between the cylinders of the respective other engagement element, said chain being formed as a spatially twistable chain.

The first engagement element is arranged along the guide element, e.g. a pipe or one of several pipes. The engagement element can be easily adapted to the three-dimensional structure of the route. The chain or the chain links can be (in some cases) fixed relative rigidly to the guide device. The connections of the chain links themselves are, however, twistable in three-dimensions. The teeth of the complementary engagement element can engage with little wear, quietly and smoothly.

The inventive chain is thus formed as a joint which can rotate in at least two dimensions. Of course, for a spatially rotatable and twistable chain, three-dimensional movement of the chain links relative to one another is preferred. The chain links can be rotated against each other, for example, about an axis corresponding to the direction in which the chain extends and about the two axes perpendicular thereto. As a result, twisted sections of the circuit can be realized with lower design effort. The deviations in tooth engagement are reduced through the use of the inventive chain.

The inventive chain can, despite a substantially (including three-dimensionally) twisted rail, replace a complex and accurately manufactured conventional rack or cage, etc., to effect optimal and yet cost-effective positive locking. The chain can be readily adapted to the twists in the rails. Even twists transverse to the chain direction can be easily realized.

The joints are especially designed as ball joints or spherical joints. The chain has chain links, wherein in each case adjacently arranged chain links are connected by means of the ball joint. It would also be conceivable to arrange two series-arranged swivel joints for the purpose of realizing a two-dimensionally rotatable chain.

The joints each have at least one spherical element which is connected to a pin or a sleeve of a first chain link, and a spherical bearing shell in which the spherical member is rotatably accommodated, said spherical bearing shell being connected to a second adjacent chain link.

The chain links especially each have at least one tooth, in whose pitch circle a ball joint is arranged.

The toothing of the chain has especially at least one concave section between adjacent teeth, which is designed for rolling off a cylinder.

The concave section preferably has at least section-wise a cycloid flank or flank contour or an approximately cycloid flank.

In general, a chain can undergo a certain degree of elongation under load. In its present application in the transport system, however, the chain is mounted to the guide device at short intervals. Unwanted strain and related pitch errors are avoided as a result.

The guide device of the transport system is preferably configured as a monorail. This also achieves the object of creating a transport system that can be integrated into the landscape and, in the case of roller coaster vehicles, can heighten the thrill, as the route is less easy to anticipate.

At least one or more of the guide elements may be pipe-shaped. Pipe-shaped guide elements have the advantage that they can be bent in three dimensions in a simple manner to facilitate routes with curvatures in different directions, e.g. curves, rises, twists, and combinations thereof. Instead of the pipes, pipe-like or solid rails can be used in the context of the invention to the extent that this is useful from the point of view of dimensions (e.g. in the case of a second guide element having a small diameter or smaller dimensions). Moreover, the term "pipe" is not limited to pipes of circular cross-section, but includes pipes of all possible cross-sections, e.g. oval cross-sections, rectangular cross-sections, irregular cross-sections, etc.

Protection is sought for all of these features, both individually and in combinations with each other.

BRIEF DESCRIPTION OF THE FIGURES

Further advantages and characteristics of the invention will become apparent from the description of preferred embodiments with reference to the figures. These show in FIG. 1 a perspective view of a conventional guide system for a rail passenger transport system.

DETAILED DESCRIPTION

The embodiment described below relates to a rail passenger transport system in the private sector. The transport system can be used in any other application for which it is suitable, however.

Figure 1:
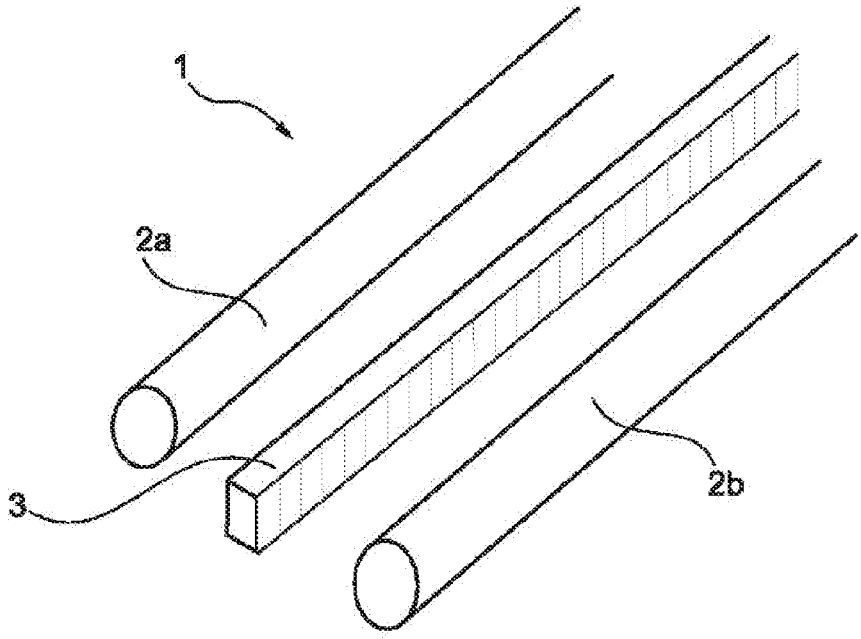
Fig. 1 Prior Art

FIG. 1 shows a conventional guide system 1 according to the embodiment. The guide system 1 comprises two parallel rails 2*a* and 2*b* for guiding dual track vehicles along a circuit as well as a rack 3 arranged centrally between the rails 2*a*, 2*b*.

Figure 2:
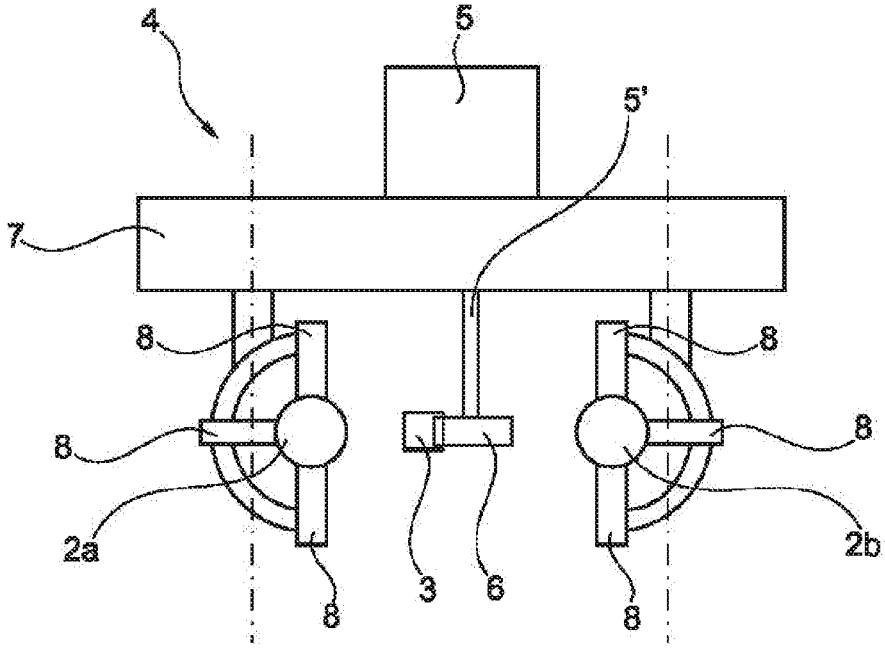
Fig. 2 Prior Art
FIG. 2 a cross-sectional view of a conventional guide system with a vehicle.

As shown in FIG. 2, the rack 3 is intended for positive drive of a vehicle 4. In this regard, a gear wheel 6, mounted at the vehicle 4 and drivable by means of a motor 5, engages with the rack 3. The motor 5 is connected to the chassis 7 of the vehicle 4. A shaft 5' of the motor drives the gear wheel 6. The chassis 7 is guided along the circuit via rollers 8, which make contact with the rails 2*a* and 2*b*. The drive can have a shaft and/or transmission but can also be formed as a direct drive (e.g. wheel hub motor) without shaft/transmission, or just with transmission and pinion, i.e. without shaft. An electromagnetic or hydraulic drive or a combination thereof can serve as drive motor.

Figure 3:
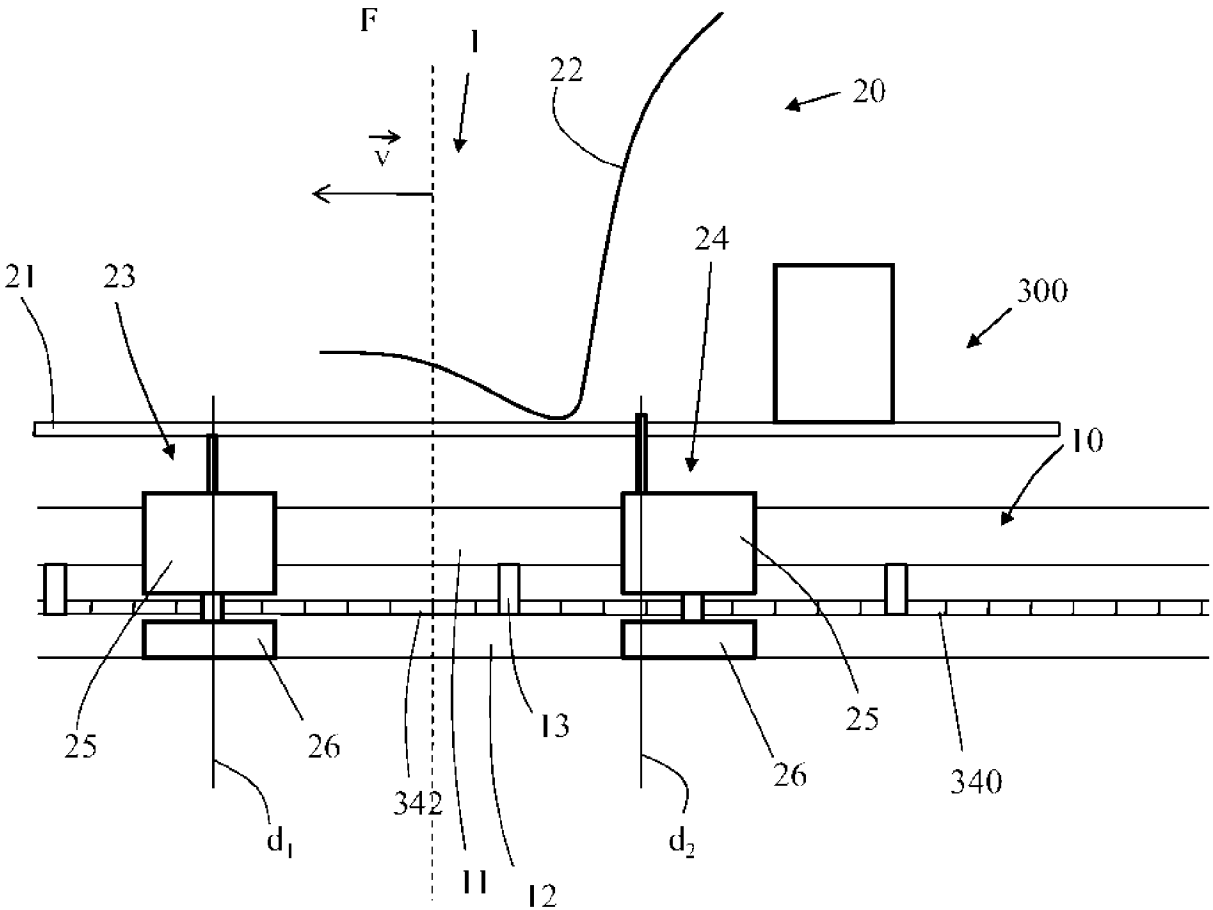
FIG. 3 a side view of a first embodiment of an inventive rail passenger transport system.

FIG. 3 shows a side view of an inventive transport system. This has a circuit 10 and a vehicle 20. The vehicle 20 is movably connected thereto along the circuit 10 (velocity vector v).

The circuit 10 comprises a first guide rail in the form of a first pipe 11 and a second guide rail in the form of a second pipe 12. The first guide rail 11 and the second guide rail 12 are arranged, from the viewpoint of a passenger accommodated in the vehicle 20, at different distances from the vehicle 20. In particular, they are not next to each other, but rather arranged vertically beneath the passenger receptacle of the vehicle 20 or beneath one another and below the passenger receptacle. Between the guide rails 11 and 12, which are parallel to each other and parallel to the direction of movement v of the vehicle 20, there is provided (along the circuit) a constant distance. However, if thrill elements are formed in which the vehicle 20 (relative to the direction of movement v) is rotated laterally, the plane E defined by the guide rails 11 and 12 (see FIG. 4) can be rotated, i.e. in absolute terms, the guide rails 11 and 12 can arbitrarily change their position relative to each other along the circuit 10. The mutual distance always remains constant in this regard. The vehicle 20 also rotates laterally with a rotation of the plane E. The first guide rail 11 and second guide rail 12 are rigidly interconnected at spaced intervals by means of connecting elements 13 provided along the circuit 10. The first guide rail 11 is always the guide rail facing the vehicle 20 (vehicle-side guide rail), while guide rail 12 is always the guide rail facing away from the vehicle 20.

The vehicle 20 has a chassis 21 and passenger receptacles connected thereto, e.g., a seat 22. A front carriage or front wheel shield/running gear 23 is rotatably mounted in the front region of the chassis 21 about an axis d1, while a rear carriage or rear wheel shield/running gear 24 is rotatably mounted in the rear region of the chassis 21 about an axis d2.

Figure 4:
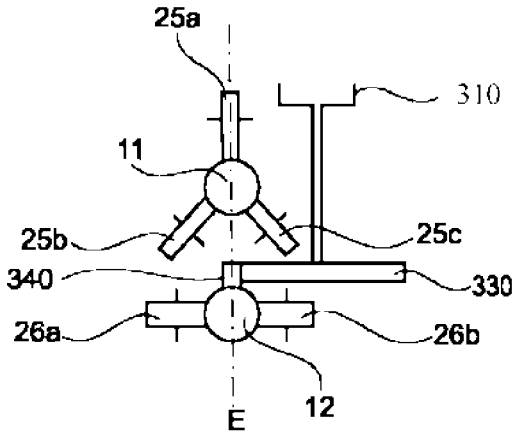
FIG. 4 a cross-sectional view from FIG. 3.

Each of the carriages 23 and 24 has a number of first rollers 25 (not shown in detail in FIG. 3; see FIG. 4), which make contact with the first guide rail 11 facing the vehicle 20. As FIG. 4 shows, for example, three positions 25*a*, 25*b*, 25*c* can be provided for the first rollers 25. The three positions 25*a*, 25*b*, 25*c* are aligned with each other such that not only does the first guide rail 11 carry the weight of the vehicle 20, but also lifting or movement of the vehicle 20 relative to the circuit 10 in anything other than the intended direction of movement v is prevented. The first guide rail 11 can be referred to as a carrier rail and/or retaining rail.

In addition, each of the carriages 23 and 24 has a number of second rollers 26 (not shown in detail in FIG. 3; see FIG. 4), which make contact at the second guide rail 12 facing away from the vehicle 20. As shown in FIG. 4, for example, two positions 26*a*, 26*b* may be provided for the second rollers 26. The two positions 26*a*, 26*b* are aligned opposite each other relative to the second guide rail 12. The second rollers 26 make lateral contact with the second guide rail 12. The arrangement is chosen such that the second guide rail 12 does not have to accommodate the weight of the vehicle 20. The second guide rail 12 serves only to prevent lateral tilting of the vehicle relative to the plane E described by the guide rail 11 and the second guide rail 12. The second guide rail 12 thus determines the lateral orientation of the vehicle 20 perpendicular to the direction of movement v, wherein a lateral tilting of the vehicle 20 along the circuit 10 is effected by a change in the position of the plane E (which is described by the two guide rails) and the corresponding laterally acting forces are transmitted through the second rollers 26 to the guide rail 12. The second guide rail 12 can be regarded as a rail for lateral stabilization of the vehicle 20. Both guide rails 11 and 12 in the illustrated embodiment are pipe-shaped.

Together, the two guide rails 11 and 12 accurately determine the (absolute) position of the carriage 20 at any point on the circuit. Targeted guiding of the carriage along the entire circuit is possible. By means of the inventive design, not only can simple curves or twists of the vehicle 20 be realized in a plane perpendicular to the direction of movement v, but also combinations of these movements with climbs and downward sloping sections. Hence complex routes such as spiral-like twists, corkscrews, camel backs, etc. can be constructed.

The inventive transport system 10 also comprises a drive system 300. This has a drive motor 310 arranged on the chassis 21 of the vehicle 20. Via a shaft, the drive motor is connected to a wheel disc 330 to drive it rotatably. The wheel disc has toothing, which will be described in greater detail.

In addition, the drive system 300 includes a toothing element (toothing section) 340, which is arranged at one of the rails. The toothing element is mounted in this case at the side of the lower rail 12 facing the upper rail 11 and extends along the rail 12.

Figure 5:
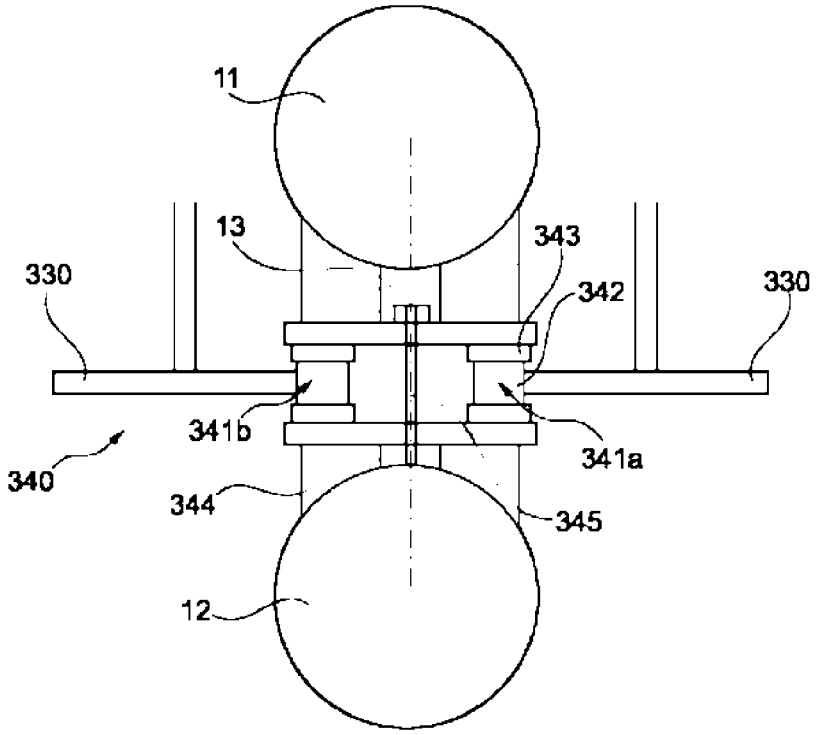
FIG. 5 a cross-sectional view of an embodiment of a guide and drive system in accordance with the present invention.
Figure 7:
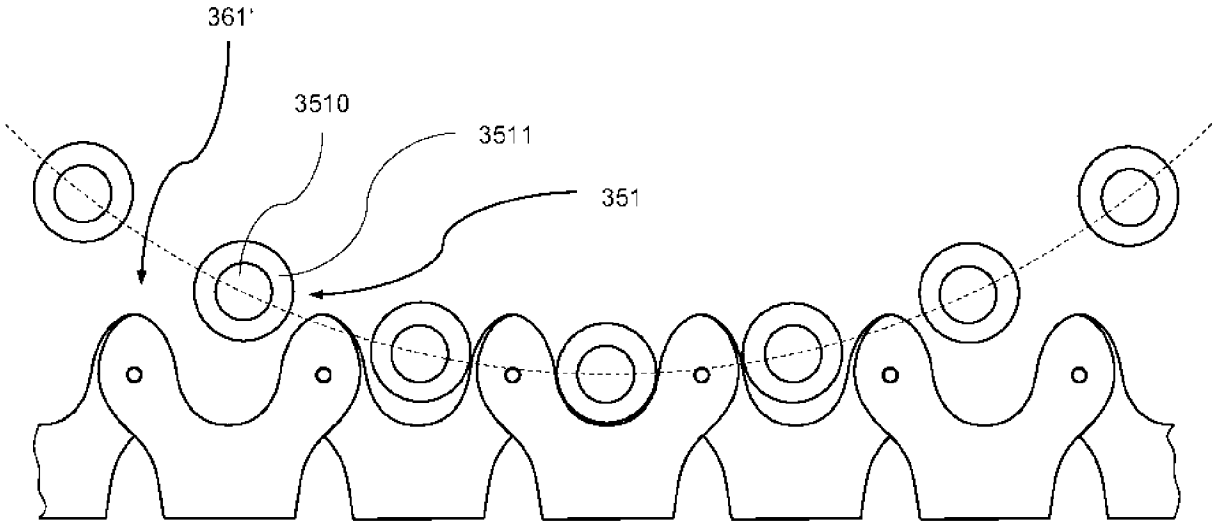
FIG. 7 an embodiment of an inventive drive system in accordance with the invention.

An example of the inventive drive system, which is used in the previously described embodiments, is illustrated in more detail in FIG. 5. Accordingly, the wheel disc 330 engages by its outer gearing with the complementary engagement recesses of a toothing element 340 extending along the lower pipe 12. The toothing element 340 comprises a longitudinal toothing 341 with chain links, rollers, sleeves or pins 342 which are spaced apart from one another along the pipe 12. The rollers 342 are rotatably mounted. Pairs of adjacent rollers 342 are connected to each other by means of at least one connecting member 343. An example of toothing is shown in FIG. 7.

In the embodiment shown in FIG. 5, a chain 341*a* or 341*b* is attached to both sides of an elastic support 344. The carrier 344 is attached hereto by means of one or more pins 345 which are spaced apart from each other along the pipe 12. The carrier 344 can be formed as a rubber carrier to serve inter alia as a damping element between the chains 341*a* and 341*b* and the lower pipe 12.

Figure 6:
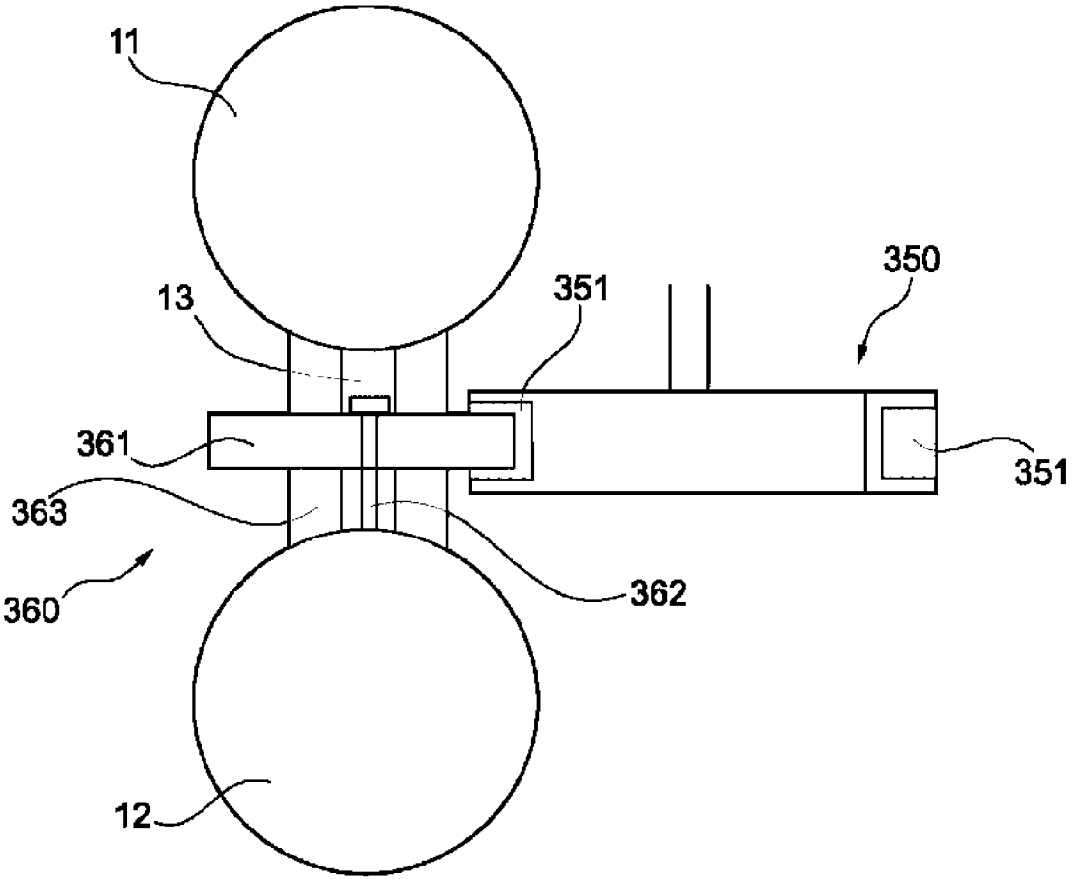
FIG. 6 a cross-sectional view of a further embodiment of a guide and drive system in accordance with the present invention.

A further embodiment of the drive system 300 which can be used in the inventive transport system is sketched in FIG. 6.

Here, the drive system 300 has a wheel 350 with cylinders 351 arranged at it in the circumferential direction. The cylinders 351 have rotatable rollers, which are mounted on sleeves. In this way, the wheel 350 is formed with a special cage gear.

The wheel 350 engages with the toothing element 360. This has essentially a rack 361 (continuous or divided) which is arranged by means of threaded bolts 362 on the side of the lower guide pipe 12 facing the upper support pipe 11. Between the lower guide pipe 12 and the rack 361 is provided a rubber carrier 363 by way of damping element. The teeth of the rack 361 engage between the cylinders 351 of the drive wheel 350.

The toothing from FIG. 7 has a wheel with cylinders 351, such as is also the case in the embodiment shown in FIG. 6. The cylinders 351 essentially consist of sleeves 3510 fixed at the wheel discs (not shown) and rollers 3511 rotatably arranged at these. Thus, the cylinders 351 roll off at the tooth flanks of a counter-toothing 361', which is formed in this case as a flyer chain.

Figure 8:
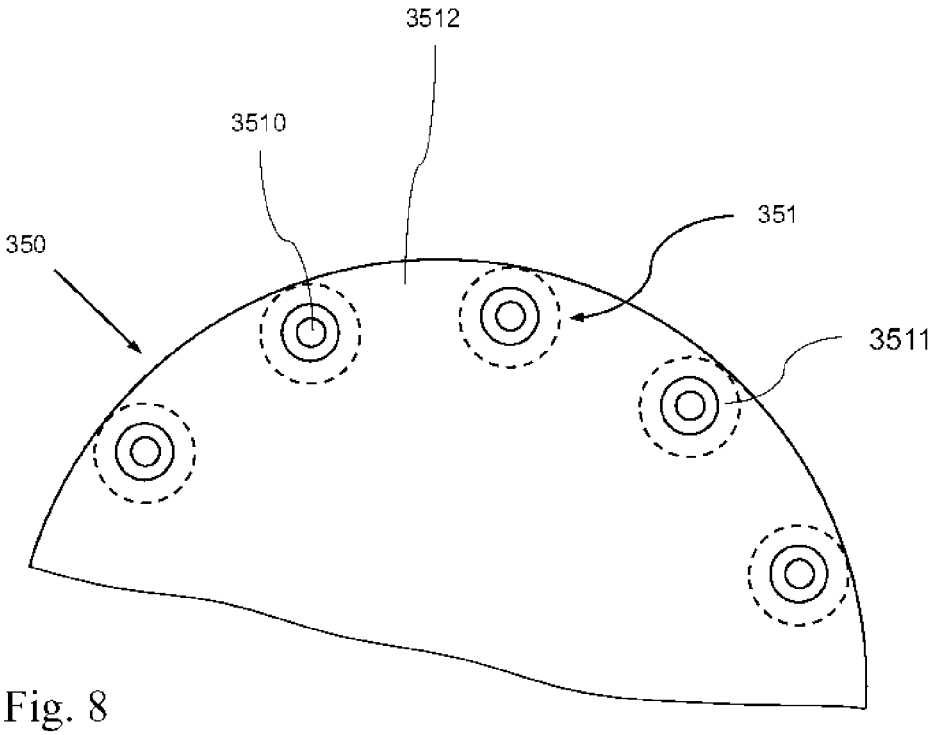
FIG. 8 a diagram of an inventive drive wheel.

FIG. 8 shows an inventive drive wheel 350 with toothing 351, which is a kind of drive wheel toothing, with cylinders 351. The drive wheel 350 has an upper drive plate 3512 and a lower drive plate 3513 (see FIG. 9). The cylinders 351 are arranged adjacent to each other between the discs 3512 and 3513 in the circumferential direction.

Figure 9:
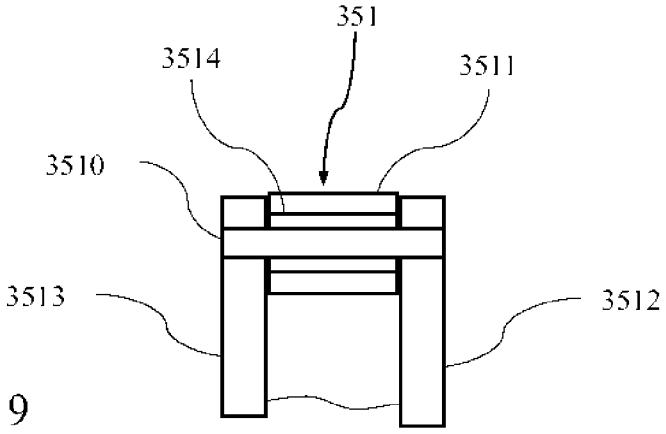
FIG. 9 a cylinder of the inventive drive wheel from FIG. 8.

FIG. 9 shows details of a single cylinder 351 from FIG. 8. Each of the cylinders 351 has a sleeve 3510 connected permanently to discs 3512 and 3513 and a roller 3511 rotatably mounted at the sleeve 3510. Sleeve (pin) 3510 acts as an axle with a rotatable roller arranged thereon 3511. The roller 3511 is connected to the sleeve 3510 by means of a rolling bearing 3514, so that only rolling friction occurs between the sleeve 3510 and 3511 of the roller. The rollers 3511 roll off on the flanks of the counter-toothing, so that only rolling friction occurs here.

Figure 10:
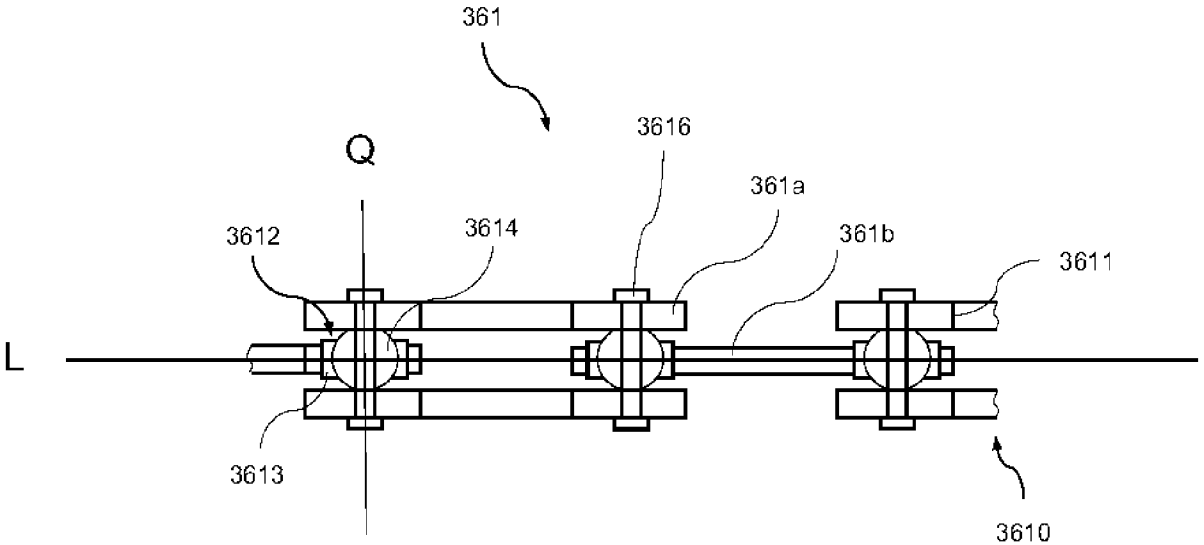
FIG. 10 a section of a spherical twistable chain in accordance with the present invention.

FIG. 10 shows a lateral view of a section of a spherically twistable chain 361 according to the present invention. The chain 361 has chain links 361*a*, 361*b*, which are located adjacent to, and connected to, each other in a row. Each chain link, e.g. 361*b*, has a base body 3610, in which a tooth flank

3611 is formed for engaging with a counter-toothing, here a cage pin 351. In a connecting region of the base body 3610 is provided a ball joint 3612. Via this, two chain links are connected rotatably both about the longitudinal axis L of the chain (as rotary axis) and axes perpendicular thereon (Q; and an axis perpendicular to the plane of the paper). The rotation angle is limited in each case, so that rotations in three dimensions are possible in a certain frame.

The ball bearing 3612 has a section 3613, which encompasses the bearing shell of the bearing 3612. In this, a spherical body 3614 of the ball bearing 3612 is rotatably arranged. Via a pin 3616, the spherical body 3614 of the joint 3612 is connected to the base body 3610. The spherical body 3614 is arranged so as to rotate in three dimensions in the bearing shell of the bearing 3612.

The use of the described toothing element provides gentle, quiet running and smooth engagement of the teeth of the chain disk or the rack. In addition, a flexible route with three-dimensional changes of direction is readily achievable. The described chain can be simply adapted to the shape of a guide pipe in the event of rising/falling sections.

Even with twisted routes (and combinations in three dimensions), it is possible to adjust the chain to the route. The chain attached at the (first) pipe is, in the event of a winding, i.e. lateral tilting of the vehicle, guided in such a way that its orientation relative to the second pipe at each circuit position of the drive section remains the same. Thus, in the present embodiment, the chain is always arranged on the side of the first pipe facing the second pipe, irrespective of the position of the pipes relative to each other at an arbitrary circuit position. In the a event of a twisting, the chain is guided between two circuit positions laterally along the circumference of the first pipe into another circumferential position. Its orientation describes a section of a helical screw thread in this regard.

The present disclosure may include one or more of the following concepts:

A. Transport system comprising:
- a vehicle (20) for accommodating at least one passenger;
- a circuit (10) with a guide device (11, 12) along which the vehicle (20) can be moved; and
- a drive system (300) for a positive drive for propelling the vehicle (20) along the circuit (10), wherein, at least on sections extending along the circuit, the drive system (300) has a first engagement element (340, 360) and a second engagement element (330, 350), which is connected to the vehicle (20) and which is propellable, characterised by the fact that at least the first engagement element or the second engagement element has cylinders (351) which are arranged at spaced intervals from each other.

B. Transport system in accordance with Paragraph A, characterised by the fact that the cylinders are arranged at the second engagement element.

C. Transport system in accordance with any of the previous Paragraphs, characterised by the fact that the cylinders each have at least one rotatable element for rolling off the cylinders at the counter-toothing.

D. Transport system in accordance with any of the previous Paragraphs, characterised by the fact that the rotatable elements have at least one bearing, preferably a rolling bearing.

E. Transport system in accordance with any of the previous Paragraphs, characterised by the fact that the cylinders each have at least one pin or a sleeve and a roller encompassing the pin or sleeve, wherein the roller is mounted rotatably at the pin or at the sleeve.

F. Transport system in accordance with any of the previous Paragraphs, characterised by the fact that the cylinders each have at least one spring damping element which is arranged between those cylinder components which are capable of moving towards each other.

G. Transport system in accordance with Paragraph F, characterised by the fact that the spring damping element is formed of elastomer.

H. Transport system in accordance with any of the previous Paragraphs, characterised by the fact that the cylinders have at least one axle and a roller that can rotate about the axle, with the axle arranged rotatably at the first engagement element or at the second engagement element by means of a bearing.

I. Transport system in accordance with any of the previous Paragraphs, characterised by the fact that the cylinders each have at least a spring damping element which is arranged between the axle and the roller.

J. Transport system in accordance with Paragraph I, characterised by the fact that the spring damping element is formed of an elastomer.

K. Transport system in accordance with any of the previous Paragraphs, characterised by the fact that the cylinders, in particular rollers, are formed from a material having lower wear resistance than the counter-toothing.

L. Transport system in accordance with any of the previous Paragraphs, characterised by the fact that the cylinders, in particular rollers, are formed of plastic.

M. Transport system in accordance with any of the previous Paragraphs, characterised by the fact that the counter-toothing for engaging with the cylinders is formed as a non-involute toothing.

N. Transport system in accordance with Paragraph M, characterised by the fact that the counter-toothing is formed as cycloid toothing or approximately as cycloid toothing.

O. Transport system in accordance with any of the previous Paragraphs, characterised by the fact that the counter-toothing for engagement with the cylinders comprises a rack extending along at least sections of the circuit.

P. Transport system in accordance with any of the previous Paragraphs, characterised by the fact that the counter-toothing for engaging with the cylinders comprises a chain extending at least along sections of the circuit, in particular a flyer chain formed as a silent chain.

Q. Transport system in accordance with any of the previous Paragraphs, characterised by the fact that at least one of the engagement elements comprises a chain which extends at least along sections of the engagement element and which has external toothing for engagement between the cylinders of the respective other engagement element, said chain being formed as a spatially twistable chain.

R. Transport system in accordance with Paragraph Q, characterised by the fact that the chain has chain links, wherein in each case adjacently arranged chain links are connected to each other by means of joints which can rotate in at least two directions.

S. Transport system in accordance with Paragraph R, characterised by the fact that the joints are designed as ball joints or spherical joints.

T. Transport system in accordance with Paragraph R or S, characterised by the fact that the joints each have at least one spherical element which is connected to a pin or a sleeve of a first chain link, and a spherical bearing shell in which the spherical member is rotatably accommodated, said spherical bearing shell being connected to a second adjacent chain link.

U. Transport system in accordance with any of Paragraphs Q to T, characterized by the fact that the chain links especially each have at least one tooth, in whose pitch circle a ball joint is arranged.

V. Transport system in accordance with any of Paragraphs Q to U, characterized by the fact that the toothing of the chain has especially at least one concave section between adjacent teeth, which is designed for rolling off a cylinder.

W. Transport system in accordance with Paragraph V, characterised by the fact that the concave section has at least section-wise a cycloid flank or flank contour or an approximately cycloid flank.

X. Transport system in accordance with any of the previous Paragraphs characterised by the fact that the guide device (10) is formed as a monorail.

Y. Transport system in accordance with any of the previous Paragraphs characterised by the fact that at least one or more of the guide elements (11, 12) are pipe-shaped.

The invention claimed is:

1. A transport system comprising:

a vehicle for accommodating at least one passenger;

a circuit with a guide device along which the vehicle can be moved; and a drive system for a positive drive for propelling the vehicle along the circuit, wherein, at least on sections extending along the circuit, the drive system has a first engagement element and a second engagement element, which is connected to the vehicle and which is propellable, wherein at least the second engagement element comprises a pinion having a plurality of cylinders which are arranged at spaced intervals from each other along the circumference of the pinion, and the first engagement element has a counter-toothing comprising a plurality of teeth, each of them having at least one flank;

the cylinders each have at least one rotatable element for rolling off the cylinders along the flanks of the teeth of the counter-toothing, and the cylinders each have at least a damping element which is arranged between those cylinder components which are capable of moving relative to each other.

2. The transport system in accordance with claim 1, wherein the cylinders are arranged at the second engagement element.

3. The transport system in accordance with claim 1, wherein the rotatable elements have at least one bearing.

4. The transport system in accordance with claim 3, wherein the at least one bearing is a roller bearing.

5. The transport system in accordance with claim 1, wherein the cylinders each have at least one pin or a sleeve and a roller encompassing the pin or sleeve, wherein the roller is mounted rotatably at the pin or at the sleeve.

6. The transport system in accordance with claim 1, wherein the damping element is formed of elastomer.

7. The transport system in accordance with claim 1, wherein the cylinders have at least one axle and a roller that can rotate about the axle, with the axle arranged rotatably at the first engagement element or at the second engagement element using a bearing.

8. The transport system in accordance with claim 7, wherein the rollers are formed from a material having lower wear resistance than a counter-toothing.

9. The transport system in accordance with claim 7, wherein the rollers are formed of plastic.

10. The transport system in accordance with claim 7, wherein the cylinders each have at least a spring damping element which is arranged between the axle and the roller.

11. The transport system in accordance with claim 10, wherein the spring damping element is formed of an elastomer.

12. The transport system in accordance with claim 7, wherein the cylinders are formed from a material having lower wear resistance than a counter-toothing.

13. The transport system in accordance with claim 12, wherein the counter-toothing for engaging with the cylinders is formed as a non-involute toothing.

14. The transport system in accordance with claim 12, wherein the counter-toothing is formed as cycloid toothing or approximately as cycloid toothing.

15. The transport system in accordance with claim 12, wherein the counter-toothing for engagement with the cylinders comprises a rack extending along at least sections of the circuit.

16. The transport system in accordance with claim 12, wherein the counter-toothing for engaging with the cylinders comprises a chain extending at least along sections of the circuit.

17. The transport system in accordance with claim 16, wherein the chain extending at least along sections of the circuit comprises a flyer chain formed as a silent chain.

18. The transport system in accordance with claim 7, wherein the cylinders are formed of plastic.

19. The transport system in accordance with claim 1, wherein at least one of the first and second engagement elements comprises a chain which extends at least along sections of the first or second engagement element and which has external toothing for engagement between the cylinders of the respective other engagement element, said chain being formed as a spatially twistable chain.

20. The transport system in accordance with claim 19, wherein the chain has chain links, further wherein in each case adjacently arranged chain links are connected to each other by one or more joints which can rotate in at least two directions.

21. The transport system in accordance with claim 20, wherein the joints are designed as ball joints or spherical joints.

22. The transport system in accordance with claim 20, wherein the joints each have at least one spherical element which is connected to a pin or a sleeve of a first chain link, and a spherical bearing shell in which the spherical member is rotatably accommodated, said spherical bearing shell being connected to a second adjacent chain link.

23. The transport system in accordance with claim 20, wherein the chain links each have at least one tooth, in whose pitch circle a ball joint is arranged.

24. The transport system in accordance with claim 23, wherein the toothing of the chain has at least one concave section between adjacent teeth, which is designed for rolling off a cylinder.

25. The transport system in accordance with claim 24, wherein the concave section has at least section-wise a cycloid flank or a flank contour or an approximately cycloid flank.

26. The transport system in accordance with claim 1, wherein the guide device is formed as a monorail.

27. The transport system in accordance with claim 1, wherein at least one or more of the guide elements are pipe-shaped.

28. A transport system comprising:

a vehicle for accommodating at least one passenger;

a circuit with a guide device along which the vehicle can be moved;

a drive system for a positive drive for propelling the vehicle along the circuit, wherein, at least on sections extending along the circuit, the drive system has a first engagement element and a second engagement element, which is connected to the vehicle and which is propellable, wherein at least one of the first engagement element and the second engagement element has a plurality of cylinders which are arranged at spaced intervals from each other; and a counter toothing, wherein the counter-toothing is formed as cycloid toothing or approximately as cycloid toothing.

29. A transport system comprising:

a vehicle for accommodating at least one passenger;

a circuit with a guide device along which the vehicle can be moved;

a drive system for a positive drive for propelling the vehicle along the circuit, wherein, at least on sections extending along the circuit, the drive system has a first engagement element and a second engagement element, which is connected to the vehicle and which is propellable, wherein at least one of the first engagement element and the second engagement element has a plurality of cylinders which are arranged at spaced intervals from each other; and a counter toothing, wherein the cylinders, or parts thereof, are formed from a material having lower wear resistance than a counter-toothing.

* * * * *